US006175963B1

(12) United States Patent
Loeffelholz

(10) Patent No.: US 6,175,963 B1
(45) Date of Patent: Jan. 23, 2001

(54) ATTIRE HAVING MAGNETICALLY AFFIXED EMBLEMS

(76) Inventor: Glenn M. Loeffelholz, 2681 W. Camino de Las Grutas, Tuson, AZ (US) 85742

( * ) Notice: Under 35 U.S.C. 154(b), the term of this patent shall be extended for 0 days.

(21) Appl. No.: 09/343,877

(22) Filed: Jun. 30, 1999

(51) Int. Cl.[7] ..... A42B 1/24
(52) U.S. Cl. ..... 2/204.13; 2/209.12; 2/200.1
(58) Field of Search ..... 2/209.12, 209.13, 2/175.1, 200.1, 195.1

(56) References Cited

U.S. PATENT DOCUMENTS

| | | | | |
|---|---|---|---|---|
| 459,942 | * | 9/1891 | Brown | 2/10 |
| 4,667,274 | | 5/1987 | Daniel . | |
| 4,776,043 | | 10/1988 | Cloeman . | |
| 5,003,640 | | 4/1991 | Pizzacar . | |
| 5,136,726 | | 8/1992 | Kellin et al. . | |
| 5,253,368 | | 10/1993 | Blake . | |
| 5,276,985 | | 1/1994 | Halloran . | |
| 5,282,278 | | 2/1994 | Miner . | |
| 5,287,559 | | 2/1994 | Christiansen et al. . | |
| 5,359,733 | | 11/1994 | Brannon et al. . | |
| 5,359,734 | | 11/1994 | Rathburn . | |
| 5,410,761 | | 5/1995 | Connelly et al. . | |
| 5,418,981 | | 5/1995 | Miner . | |
| 5,442,817 | | 8/1995 | Miner . | |
| 5,452,479 | | 9/1995 | Mostert . | |
| 5,740,557 | * | 4/1998 | Reid et al. | 2/209.13 |
| 5,898,946 | * | 5/1999 | Keating et al. | 2/209.13 |
| 5,901,370 | * | 5/1999 | Linday | 2/10 |
| 5,996,116 | * | 12/1999 | Tate | 2/12 |

* cited by examiner

*Primary Examiner*—Bibhu Mohanty
(74) *Attorney, Agent, or Firm*—R. Michael West; Boutin, Dentino, Gibson, Di Giusto, Hodell & West

(57) ABSTRACT

A system and method for detachably securing emblems, or the like, to articles of clothing, such as caps, hats, shirts, jackets, belts, and shoes. The system employs the combination of two magnetically attractive elements, for example, a magnet and a plate or a piece of ferromagnetic material. One or more magnets or pieces of the ferromagnetic material may be embedded in or adhesively attached to the clothing. Similarly, one or more magnets or pieces of the ferromagnetic material may be embedded in or attached to one or more emblems. The emblems are placed over selected ones of the magnetically attractive elements in the clothing, and thereby magnetically secured thereto. The method contemplates that a user may retrofit new or existing clothing, to enjoy the advantages of the present invention, without having to buy either new or specially manufactured clothing.

12 Claims, 2 Drawing Sheets

ATTIRE HAVING MAGNETICALLY AFFIXED EMBLEMS

BACKGROUND OF THE INVENTION

1. Field of the Invention

The invention relates generally to accessories for clothing apparel, such as caps, hats, jackets, shirts, pants, belts, and shoes. More specifically, the invention pertains to emblems having printed or graphic designs thereon relating to entertainment characters, movies, sports, schools, or associations, and which are adapted to be magnetically affixed to apparel.

2. Description of the Prior Art

It is well known in the art to stitch or adhesively affix patches and badges to casual attire such as caps, shirts, and jackets. Typically, the patches and badges incorporate and display printed information, logos, and other fanciful designs, pertaining to team sports, school affiliation, and the like. Because the patches are permanently attached to an article of clothing, it is necessary for the wearer to purchase a different cap for each patch, or like display element, to be worn. To eliminate the need for having different articles of clothing for each different patch, changeable patches or display elements have been developed in the prior art.

For example, U.S. Pat. No. 4,667,274 describes a cap having a self-illuminating patch assembly. A reflector unit having a light diffusion screen and a light are mounted in the front of a cap. Indicia or a logo can be applied directly on the screen or, alternatively, on an interchangeable film which can be placed over the screen. Because both the screen and the film are readily changed, different indicia and graphics can be displayed using the single cap.

U.S. Pat. No. 4,776,043 teaches a cap having a rectangular patch of the loop portion of a hook-and-loop fastener, mounted on the brow portion of the cap. Various logos equipped with hook fastener portions can thereby be detachably affixed to the cap.

U.S. Pat. No. 5,003,640 discloses a cap having a pair of rear positioned straps for adjusting the size of the cap. A nameplate can be removably mounted on the straps by passing the straps through mounting bars on the nameplate. Alternatively, the nameplate can be affixed to the straps via a hook-and-loop fastener, or to a pin provided on one of the straps and receivable by an opening in the nameplate.

U.S. Pat. No. 5,136,726 illustrates articles of clothing made from a stretchable material having a plurality of loop elements therein. One or more decorative elements equipped with hook portions can be removably secured to the clothing.

U.S. Pat. No. 5,253,368 shows a cap with an erasable billboard, or writing surface, on its crown portion. The erasable billboard, a writing implement, and an eraser are all detachably affixed to the cap by means of hook and loop fasteners.

U.S. Pat. No. 5,276,985 shows a detachable plaque for a cap having a crown portion and a visor portion. The plaque has two hingeably connected segments, one segment being affixed to the crown while the other segment is affixed to the visor, by means of snaps or hook-and-loop fasteners. The segment which lies against the crown has a surface designed for the application of indicia thereto or, alternatively, is provided with a slot for insertion of a display card.

U.S. Pat. Nos. 5,282,278, 5,418,981, and 5,442,817, issued to Miner, all teach an emblem bearing cap. A cap attachment is fabricated from a relatively stiff material. The attachment is folded about a primary crease, defining an upper facing panel and a lower backing panel. The attachment is then folded over the lower, rear edge of the cap, and releasably secured thereto by hook-and-loop fasteners, snaps, double-sided adhesive tape, or similar means. The facing panel allows the display of emblems or other indicia.

U.S. Pat. No. 5,287,559 discloses a cover comforter for the sizing straps of a baseball cap. The padded comforter consists of a pair of hingeably connected panels provided with hook-and-loop fasteners. The attachment is folded over the straps and the panels are secured together using the fasteners. An outwardly facing panel of the comforter carries a logo.

U.S. Pat. No. 5,359,733 shows a cap which includes one or more sections of hook material that may simultaneously accept a plurality of patches. The hat and patches may be provided in the form of a kit.

In U.S. Pat. No. 5,359,734, the front vertical face of a cap includes a rectangular opening having a seam formed about its periphery. The opening is filled with a rectangular piece of material including fastening hooks. A number of cloth panels, each substantially the same size as the opening, bear a name, logo, or character on one display side, and pile material on the attachment side for placement over the piece having hooks.

U.S. Pat. No. 5,410,761 shows a cap having a visor provided with an insert. A number of pictorial displays are placed over the insert. The insert is protected by a clear envelope which is slipped over the visor and secured thereto by a hook-and-loop fastener. The envelope may also carry pictorial display elements and may also be made from a fabric.

Lastly, in U.S. Pat. No. 5,452,479, the combination of a cap and a clear plastic case for holding articles such as licenses and photographs, is disclosed. The case can be permanently secured to the cap, or may be removably attached thereto by hook-and-loop fasteners.

The above-described prior art has a number of drawbacks. For example, the cap attachments in the form of frames, cases and plaques detract from the appearance of a cap, whether they contain an insert or not. The fixed configuration of the frame or holder also limits the range of emblem configurations it can accommodate. Lastly, the emblem or other indicia can only be located where the frames or cases are located on the cap.

Emblem or patch attachments, designed to be mounted on or over the rear positioned, size adjustment straps, cannot be employed universally to all caps. Moreover, such attachments can only display emblems rearwardly.

A cap such as that shown in U.S. Pat. No. 5,136,726, having on outer surface consisting entirely of hook or loop elements, has its own unique problems. If the user brushes against certain objects, the cap may become attached thereto. Moreover, the exposed surface portions will readily pick up lint and other substances which make the cap look dirty or shabby. Other cap designs, which use hook or loop elements in plural locations, have similar problems unless each of the elements is covered at all times.

Thus, there is room for improvement in attire to which patches, emblems, and the like may be detachably secured. The present invention solves many of the above-identified problems by employing a detachable means of emblem securement which is economical, flexible, and esthetically pleasing.

SUMMARY OF THE INVENTION

The invention may be used advantageously in connection with any type of apparel, but will be described herein principally for use with caps, hats, shirts, and jackets. The invention employs the combination of two magnetically attractive elements, for example, a magnet and a plate or a piece of ferromagnetic material. These magnetically attractive elements provide a convenient means for detachable securement of the patch, emblem, or display element to a non-magnetic article of clothing.

In a particular application, it may be desirable to have the magnet, or magnets, on the patch and the ferromagnetic material embedded in or attached to the attire. For example, a large patch may require a number of smaller magnets, strategically located on its underside, for effective securement to a single plate of ferromagnetic material. On the other hand, it may be desirable to place a plurality of magnets at different locations on or around an article of clothing, for securement of one or more patches or display elements, each of which includes its own piece of magnetically attractive material. If large attractive forces are required, it may also be desirable to use a pair of magnets, one affixed to the apparel and the other affixed to the patch or display element. In this arrangement, the adjacent faces of the magnets will, of course, have to be of opposite magnetic polarity to generate attractive forces.

A magnet or the ferromagnetic piece, termed a first magnetically attractive element, herein, may be fitted into the fabric or material of the personal attire, so as to be unnoticeable. Since magnetic lines of force are not blocked by the fabric or other non-metallic materials normally used for attire, the first magnetically attractive element is secured between layers of fabric, or within a specially fabricated pocket. Alternatively, the first magnetically attractive element may be adhesively affixed directly to an inner surface of the attire. Similarly, a second magnetically attractive element is secured to the underside of a patch, emblem, or display element, or is imbedded within the fabric to or material of that display element.

The magnetically attractive element in the attire can thereby hold a display element securely in place on the exterior surface portion of the attire, and nevertheless remain visibly unobtrusive. Furthermore, inasmuch as magnets are available in many different forms and can be incorporated in objects in various ways, virtually any article of clothing and any display element can be provided with magnetically attractive elements.

Another aspect of the invention resides in a method of retrofitting new or existing attire, enjoying the advantages of the present invention. The method comprises the first step of affixing a first magnetically attractive element at one or more selected locations upon the inner surface of the attire. Alternatively, the element may be secured at one or more selected locations within the fabric or other material of the attire. Then, in a following step, one or more patches or display elements, containing a second magnetically attractive element, is affixed to one or more of the selected locations on the attire.

It is an object, therefore, of the present invention to provide a convenient means for detachably securing a patch or display element upon any exterior surface portion of a cap, hat, jacket, or other attire, while remaining relatively unobtrusive.

Another object of the invention is to provide a detachable securement system which can be used for attachment of a display element to virtually any kind of attire.

Yet another object of the invention is to provide a means for detachably securing a plurality of patches or display elements to the same or to different areas on attire.

Yet another object of the invention is to provide a method of retrofitting new or existing attire with the present system for detachably securing patches or display elements, so that the advantages of the invention can be enjoyed without purchasing new or specially manufactured attire.

The preceding objects, as well as others, will become apparent in the drawings and the written description of the invention to follow.

DETAILED DESCRIPTION OF THE PREFERRED EMBODIMENT

For the purposes of this disclosure, a magnet or magnetic material is defined as a body having the property of attracting iron and producing a magnetic field external to itself; a ferromagnetic body is defined as material that is attracted by a magnet; a magnetically attractive element may be either a magnet or a ferromagnetic body; and, a non-magnetic body is defined as material that is not attracted by a magnet.

Figure 1:
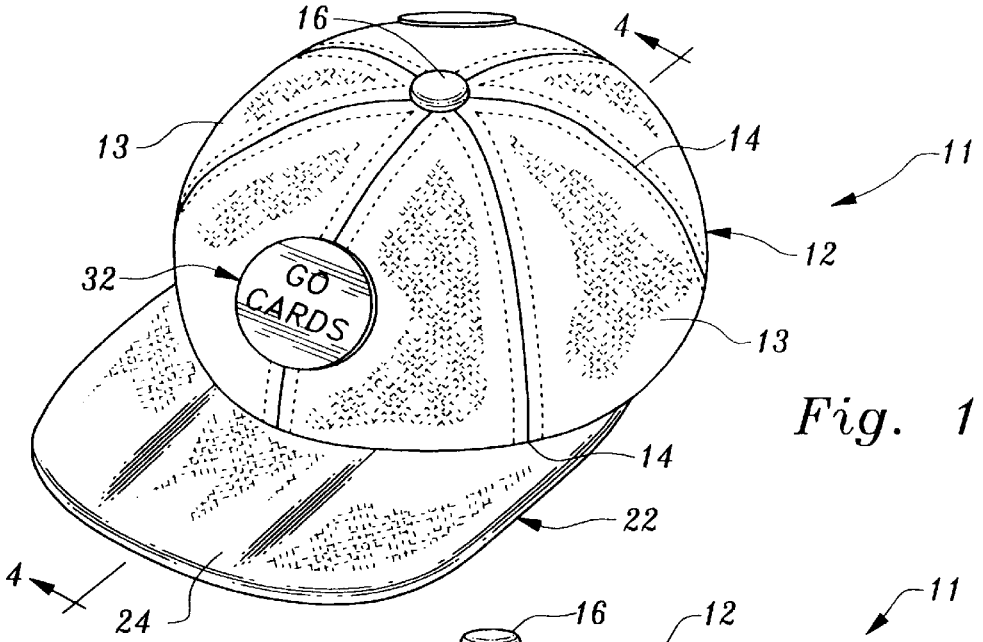
FIG. 1 is a left front perspective view of a cap and display element, incorporating the features of the present invention.
Figure 2:
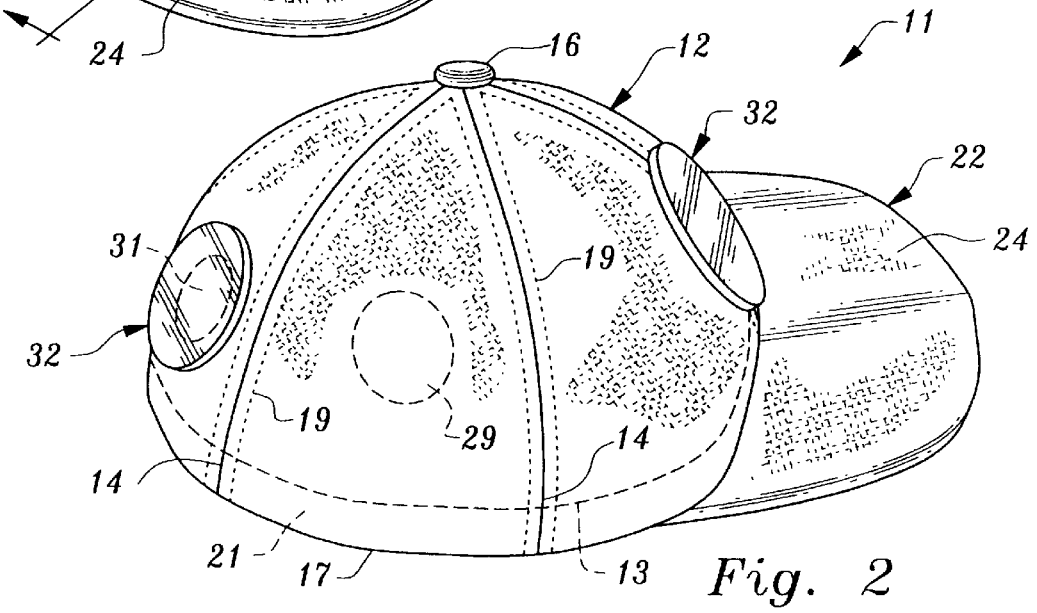
FIG. 2 is a perspective view of the side and rear portions of the cap shown in FIG. 1, showing a rear mounted emblem and the outline of two magnets in broken line.

Referring now to FIGS. 1 and 2, a cap and display element assembly 11 of the present invention is shown. Cap 12 is comprised of cloth or fabric sectors 13, cut into generally triangular pieces. Although the cap shown in the drawings includes six sectors, this number may vary with size and design. Adjacent sectors 13 are attached to each other along seams 14, extending from a button 16 at the top of the cap, to lower edge 17. Elongated strips 18 of fabric run behind each seam, and provide backing for the parallel lines of seam stitches 19. A band 21 extends around the entire inner periphery of the cap, along lower edge 17.

The cap 12 also includes a stiff visor or bill 22, which extends outwardly and forwardly from the lower front portion of the cap. The visor 22 includes an inner sheet 23 of stiff cardboard or plastic which is covered by an upper layer 24 and a lower layer 26, typically made from fabric or cloth. In the event the visor 22 is made entirely from plastic, the inner sheet 23, and coverings 24 and 26 may be eliminated.

Figure 3:
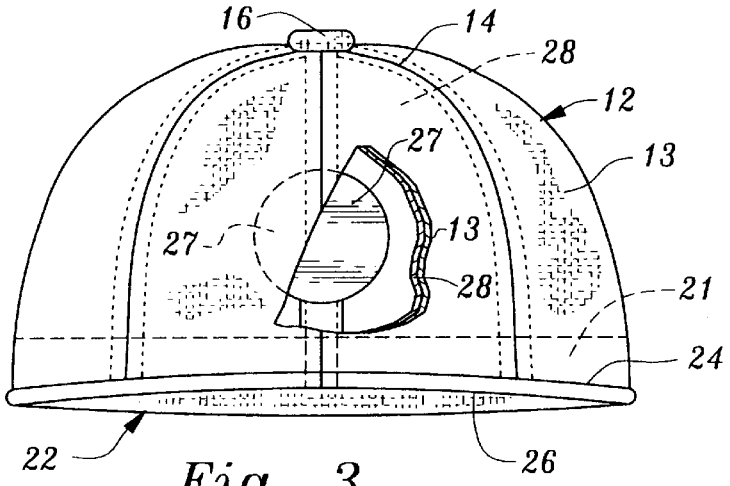
FIG. 3 is a front elevation view of the cap, with a portion of the cap's crown being broken away to reveal a normally hidden ferromagnetic plate.
Figure 4:
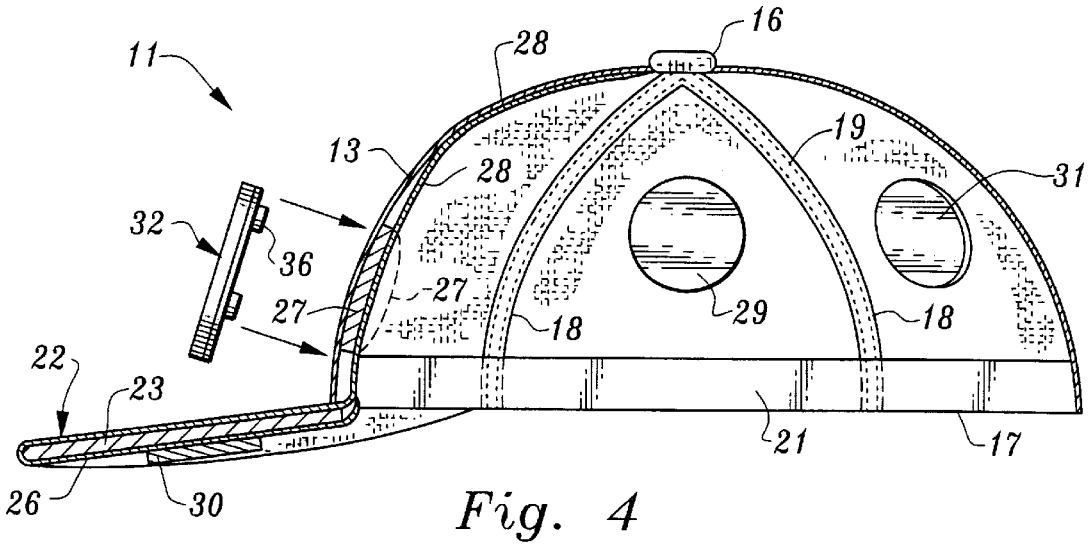
FIG. 4 is a longitudinal, cross-sectional view, taken along the lines 4—4 in FIG. 1.
Figure 5:
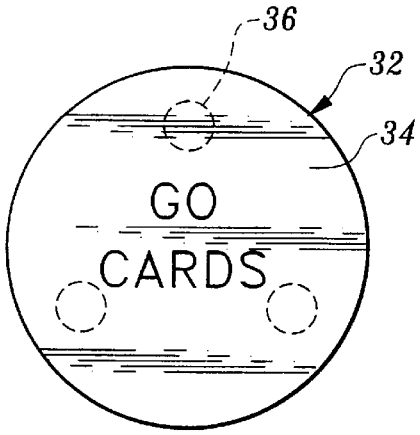
FIG. 5 is a front elevational view of the patch or display element shown in FIG. 1.
Figure 6:
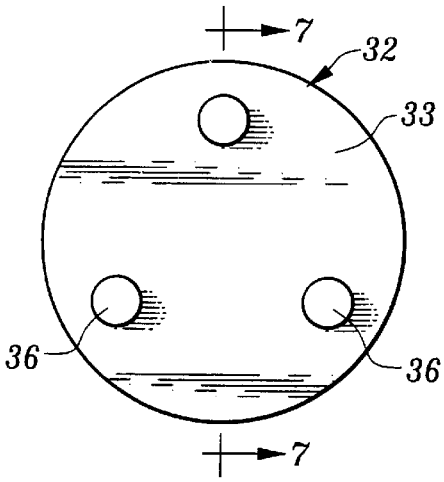
FIG. 6 is a rear elevational view of the display element shown in FIG. 5.

Making particular reference to FIGS. 3 and 4, the cap also includes a first magnetically attractive element 27, secured within or to the crown portion of the cap. Element 27 is shown in the drawings as a circular disc, but could assume other shapes, and could also include multiple segments or pieces for particular applications. In the preferred embodiment, element 27 is a ferromagnetic body, conveniently formed from a thin piece of sheet metal, approximately 1/16" thick and 2" or so in diameter. Use of sheet metal for element 27 is preferred owing to weight and expense considerations, as well as its ability to be bent into the curved configuration of the crown of the cap. However, element 27 may also be a magnetic body, or multiple magnetic bodies.

In one form of construction, an inner panel 28 is sewn or adhesively bonded over two of the front, adjacent sectors 13, in the crown portion of the cap, to form a housing or pocket for holding element 27 in place. Stitches (not shown) may be provided around element 27 to secure it within the space between the front two sectors 13 and panel 28. Alternatively, element 27 may be adhesively secured to adjacent surfaces of sectors 13 and panel 28. This type of construction is particularly well suited for use during the manufacture of a new cap. However, for the retrofit of a new cap, or the retrofit of an existing cap, the installation of a stitched inner panel 28 may not be convenient, as it is beyond the sewing capabilities of most persons. Therefore, a simple, yet effective alternative means of securing a magnetically attractive element is needed.

For that purpose, reference is now made to FIG. 4, where additional ones of the first magnetically attractive elements, designated by the numerals 29, 30, and 31, are shown. The owner of the cap may add elements 29, 30, and 31, at any time, by simply applying adhesive to one side of the element, and pressing the adhesively prepared side against the inner surface of a sector 13 or the underside of the visor 22. This retrofit method may be used for new caps, or for existing caps, and provides the owner with the ability to locate an emblem or badge at almost any location on the cap, even the visor. And, a considerable number of elements may be added, as long as space on the outside of the cap permits. Use of a rubberized adhesive permits the removal or relocation of the elements, as well.

Figure 7:
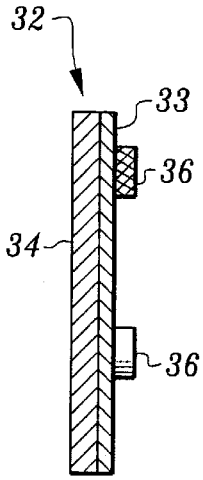
FIG. 7 is a cross-sectional view, taken long the line 7—7 in FIG. 6; and, FIG. 8 is a fragmentary view of a shirt or jacket, incorporating the features of the present invention.

A second magnetically attractive element 32 comprises a badge, emblem, or display element. Element 32 typically includes an inwardly facing base portion 33 and an outwardly facing overlay 34, as shown most clearly in FIG. 7. One or more magnets 36 may be adhered to the underside of base portion 33. Or, base portion 33 could itself be magnetic material. As yet another alternative, if the first magnetically attractive element 27 is a magnet, rather than ferromagnetic material, then the second magnetically attractive element 32 may simply be a ferromagnetic material, and include no magnets. Or, both the first and second magnetically attractive elements may include or be magnets, providing the adjacent surfaces of the respective magnets are of opposite polarities, and therefore attractive to each other.

The configuration of display element 32 may be circular, oval, square, rectangular, or irregular, as desired. Different arrangements and numbers of magnets may be required to hold such configurations securely in place. And, the corresponding size and configuration of the first magnetically attractive element 27 may have to be modified accordingly. Typically, overlay 34 includes text and a design element or logo, or a combination of the two. Overlay 34 may be a fabric, or a plastic, or a ferromagnetic material as described above. Alternatively, the overlay 34 may be eliminated, and the text, logo, or other visual representation which would otherwise be included on the overlay may be printed or formed directly on a front surface of the base portion 33.

By placing the underside of a selected second magnetically attractive element over a selected first magnetically attractive element, the emblem, badge, or display element will be magnetically attracted to and held upon the exterior surface portion of the cap 12. Of course, a particular emblem may be removed and replaced with another, or moved around the cap 12 to a different location. And, as discussed above, further alternative locations for badges may be added or removed at any time. Because the first magnetically attractive element is concealed within the cap's structure, the appearance of the cap is not adversely affected, even with no badges or emblems in use. The cap 12 can be provided as a kit, together with a variety of emblems or badges. Or, the magnetically attractive elements may be provided as a separate kit, to retrofit either new or existing caps.

Figure 8:
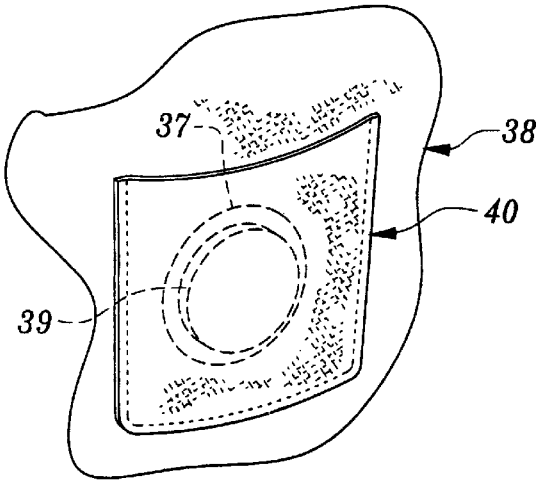

The present invention may also be used advantageously in connection with other substantially non-magnetic items of apparel, such as shirts, jackets, coats, belts, pants, and shoes. As an example, in FIG. 8, a first magnetically attractive element 37 is secured within or upon the inner fabric of a jacket 38. A pouch or pocket, such as that previously described, may be formed by sewing or adhesively affixing an inner sheet to the inner fabric of the jacket. Or, the element 37 may be glued or adhered to the inner fabric. The element 37 may be located anywhere within the jacket, but typically, it will be positioned on the breast pocket, on an arm sleeve, or on the back portion. Then, a badge or an emblem, comprising a second magnetically attractive element 40, including a magnet 39, may be placed over element 37, and magnetically secured thereto, in identical fashion to that previously described.

It will be appreciated, therefore, that I have described attire having magnetically affixed emblems, which overcomes certain problems inherent in prior art devices, yet which is economical and flexible to use, either as a separate product, or as a retrofit kit for use with new or existing items of apparel.

I claim:

1. A method for retrofitting a cap or hat with at least one detachably secured badge, patch, or emblem, the cap or hat having a lower circular band portion and an inner surface portion, comprising the steps of:

a. securing a first magnetically attractive element at a predetermined location upon said inner surface portion of the cap or hat, said predetermined location being above said circular band portion;

b. providing a second magnetically attractive element, having an outwardly facing portion with text, a logo, or other design element thereon, and an inwardly facing portion; and, c. placing said second magnetically attractive element over said first magnetically attractive element, for magnetic securement therewith.

2. The method of claim 1 in which said first magnetically attractive element is adhesively secured upon said inner surface portion of said cap or hat.

3. The method of claim 1 including a plurality of said first magnetically attractive elements, each element being secured at a respective said predetermined location above said circular band portion.

4. The method of claim 3 including a plurality of said second magnetically attractive elements for securement to selected ones of said first magnetically attractive elements.

5. A method for retrofitting a cap with at least one detachably secured badge, patch, or emblem, the cap having a bill portion extending outwardly and forwardly from a lower front portion of the cap, comprising the steps of:

a. securing a first magnetically attractive element at a predetermined location upon on an underside of said bill portion of the cap;

b. providing a second magnetically attractive element, having an outwardly facing portion with text, a logo, or other design element thereon, and an inwardly facing portion; and, c. placing said second magnetically attractive element over said first magnetically attractive element, for magnetic securement therewith.

6. In combination, a cap having a lower circular band portion, an inner surface portion, and an exterior surface portion, said cap including a first magnetically attractive element secured at a predetermined location above said circular band portion and upon said inner surface portion of said cap or hat, and, at least one detachably secured badge, patch or emblem including a second magnetically attractive element having an outwardly facing portion with text, a logo, or other design element thereon, and an inwardly facing portion, whereby, placing said inwardly facing portion of said second magnetically attractive element over said first magnetically attractive element, said badge, patch or emblem is secured to said exterior surface portion of said cap.

7. The combination of claim 6, in which said first magnetically attractive element is a ferromagnetic body.

8. The combination of claim 6, in which said first magnetically attractive element is a magnetic body.

9. The combination of claim 6, in which said second magnetically attractive element is a ferromagnetic body.

10. The combination of claim 6, in which said second magnetically attractive element is a magnetic body.

11. The combination of claim 6, in which said cap includes a crown portion, and in which said first magnetically attractive element is located at a predetermined location within said crown portion.

12. The combination of claim 11, in which said crown portion of said cap has an inner surface portion, and in which said first magnetically attractive element is adhered to said inner surface portion.

* * * * *